US009243834B2

(12) United States Patent
Kim et al.

(10) Patent No.: US 9,243,834 B2
(45) Date of Patent: Jan. 26, 2016

(54) REFRIGERATOR

(71) Applicant: LG Electronics Inc., Seoul (KR)

(72) Inventors: Seojung Kim, Seoul (KR); Yonghwan Eom, Seoul (KR); Kyeongyun Kim, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 594 days.

(21) Appl. No.: 13/630,560

(22) Filed: Sep. 28, 2012

(65) Prior Publication Data

US 2013/0081416 A1 Apr. 4, 2013

(30) Foreign Application Priority Data

Sep. 29, 2011 (KR) ..... 10-2011-0098902
Sep. 29, 2011 (KR) ..... 10-2011-0098903

(51) Int. Cl.
*F25D 21/00* (2006.01)
*F25D 21/02* (2006.01)
*F25D 21/08* (2006.01)

(52) U.S. Cl.
CPC ..... *F25D 21/02* (2013.01); *F25D 21/006* (2013.01); *F25D 21/08* (2013.01); *F25D 2700/10* (2013.01)

(58) Field of Classification Search
CPC ..... F25D 21/006; F25D 21/02; F25D 21/08; F25D 2700/10; F25B 2700/111; F25B 2700/11
USPC ..... 62/150, 151, 154–156
See application file for complete search history.

(56) References Cited

U.S. PATENT DOCUMENTS

| | | | | |
|---|---|---|---|---|
| 4,232,528 | A * | 11/1980 | Behr | 62/140 |
| 5,806,321 | A * | 9/1998 | Bendtsen et al. | 62/80 |
| 6,032,471 | A * | 3/2000 | Choi | 62/153 |
| 6,354,093 | B2 * | 3/2002 | Davis et al. | 62/89 |
| 6,964,172 | B2 * | 11/2005 | Dudley et al. | 62/80 |
| 2007/0180838 | A1 * | 8/2007 | Shah | 62/150 |
| 2008/0196419 | A1 * | 8/2008 | Dube | 62/80 |
| 2009/0100847 | A1 * | 4/2009 | Moon et al. | 62/66 |
| 2009/0235679 | A1 * | 9/2009 | Bagley | 62/140 |

* cited by examiner

*Primary Examiner* — M. Alexandra Elve
*Assistant Examiner* — Henry Crenshaw
(74) *Attorney, Agent, or Firm* — Birch, Stewart, Kolasch & Birch, LLP

(57) ABSTRACT

Provided is a refrigerator, which includes a main body, a door, an evaporator, a defrosting heater, a defrosting sensor, and a control part. The main body includes a food storage space and an evaporation compartment. The door selectively closes the food storage space. The evaporator is disposed in the evaporation compartment. The defrosting heater is disposed at a side of the evaporator to remove frost from an outer surface of the evaporation compartment or the evaporator. The defrosting sensor is disposed at a side of the evaporation compartment or the evaporator to sense a frost formation amount. The control part receives a sensed value transmitted from the defrosting sensor, and controls an operation of the defrosting heater according to the sensed value. A sensing period of the defrosting sensor is varied according to a frost formation amount sensed by the defrosting sensor.

12 Claims, 7 Drawing Sheets

REFRIGERATOR

CROSS-REFERENCE TO RELATED APPLICATIONS

The present application claims the benefits of priority to Korean Patent Application Nos. 10-2011-0098902 (filed on Sep. 29, 2011) and 10-2011-0098903 (filed on Sep. 29, 2011) which are herein incorporated by reference in their entirety.

BACKGROUND

The present disclosure relates to a refrigerator.

Refrigerators store food at a low temperature in an inner storage space closed by a door. The inner storage space can be maintained at a low temperature by continually supplying cold air thereinto. The cold air is generated by heat exchange between air and refrigerant through a cooling cycle of compression, condensation, expansion, and evaporation. The cold air supplied into the refrigerator is uniformly dispersed within the refrigerator through convection, so that food can be stored at a desired temperature in the refrigerator.

An evaporator constituting the cooling cycle is disposed in an evaporation compartment such that refrigerant exchanges heat with air circulating within the refrigerator. Since a surface temperature of the evaporator is significantly lower than an indoor temperature, while the evaporator exchanges heat with air circulating within the refrigerator, condensate water is generated on the outer surface of the evaporator. The condensate water is frozen on the evaporator or the evaporation compartment, so as to form frost. When frost is accumulated on the evaporator, heat exchange efficiency between the evaporator and inner air of the refrigerator is decreased.

To remove frost from the evaporator, a defrosting heater may be disposed at a side of the evaporator, or the cooling cycle may be reversely performed for a certain period of time, thereby melting frost formed on the evaporator. Such condensate water formed on the evaporator, or defrosted water formed by melting frost is collected in a drain pan attached to the bottom of the evaporator, and is dropped to the bottom of a machinery chamber through a drain hose.

The defrosting heater may be operated with a certain time interval, or be operated when a temperature of the evaporation compartment is equal to or lower than a specific temperature. Alternatively, whether to operate the defrosting heater may be determined according to time depending on the number of opening and closing a refrigerator door and an operation rate of the refrigerator. A defrosting sensor installed on the evaporator may sense a defrosting end time. Since such a defrosting sensor included in a typical refrigerator continuously senses a frost formation amount, power consumption is unnecessarily increased.

The defrosting sensor is disposed in a position on an evaporator where a large amount of frost is formed, and a control part starts or ends a defrosting process based on a result sensed by the defrosting sensor. In this case, the defrosting sensor cannot entirely sense the evaporator or an evaporation compartment. Thus, when the defrosting process is performed based on a result sensed by the defrosting sensor, frost formed on the evaporator or the evaporation compartment may be insufficiently removed.

In addition, the defrosting process may be performed over a defrosting time based on a result sensed by the defrosting sensor in order to ensure defrosting reliability. As a result, the power consumption is increased to operate a defrosting heater, and cooling efficiency of the refrigerator is decreased.

SUMMARY

Embodiments provide a refrigerator that varies a sensing period of a defrosting sensor according to an amount of frost formed on an evaporator.

Embodiments also provide a refrigerator that accurately determines an amount of frost formed on an evaporator and a defrosting time depending on a frost formation amount to efficiently start or end a defrosting process, thereby maximizing power consumption efficiency and cooling efficiency.

In one embodiment, a refrigerator includes: a main body including a food storage space and an evaporation compartment; a door selectively closing the food storage space; an evaporator disposed in the evaporation compartment; a defrosting heater disposed at a side of the evaporator to remove frost from an outer surface of the evaporation compartment or the evaporator; a defrosting sensor disposed at a side of the evaporation compartment or the evaporator to sense a frost formation amount; and a control part receiving a sensed value transmitted from the defrosting sensor, and controlling an operation of the defrosting heater according to the sensed value, wherein a sensing period of the defrosting sensor is varied according to a frost formation amount sensed by the defrosting sensor.

According to an embodiment, a sensing period of a defrosting sensor can be varied according to a frost formation amount sensed by the defrosting sensor, thereby reducing power consumption for driving the defrosting sensor.

In addition, since a defrosting process is accurately started just at a defrosting start time, heat exchange efficiency of an evaporator can be increased.

In addition, sensors installed on the evaporator can accurately sense a frost formation amount, and a defrosting time can be accurately calculated based on the sensed frost formation amount, thereby quickly removing frost and improving defrosting efficiency and cooling efficiency.

The details of one or more embodiments are set forth in the accompanying drawings and the description below. Other features will be apparent from the description and drawings, and from the claims.

DETAILED DESCRIPTION OF THE EMBODIMENTS

In the following detailed description of the preferred embodiments, reference is made to the accompanying drawings that form a part hereof, and in which is shown by way of illustration specific preferred embodiments in which the invention may be practiced. These embodiments are described in sufficient detail to enable those skilled in the art to practice the invention, and it is understood that other embodiments may be utilized and that logical structural, mechanical, electrical, and chemical changes may be made without departing from the spirit or scope of the invention. To avoid detail not necessary to enable those skilled in the art to practice the invention, the description may omit certain information known to those skilled in the art. The following detailed description is, therefore, not to be taken in a limiting sense, and the scope of the present invention is defined only by the appended claims.

Figure 1:
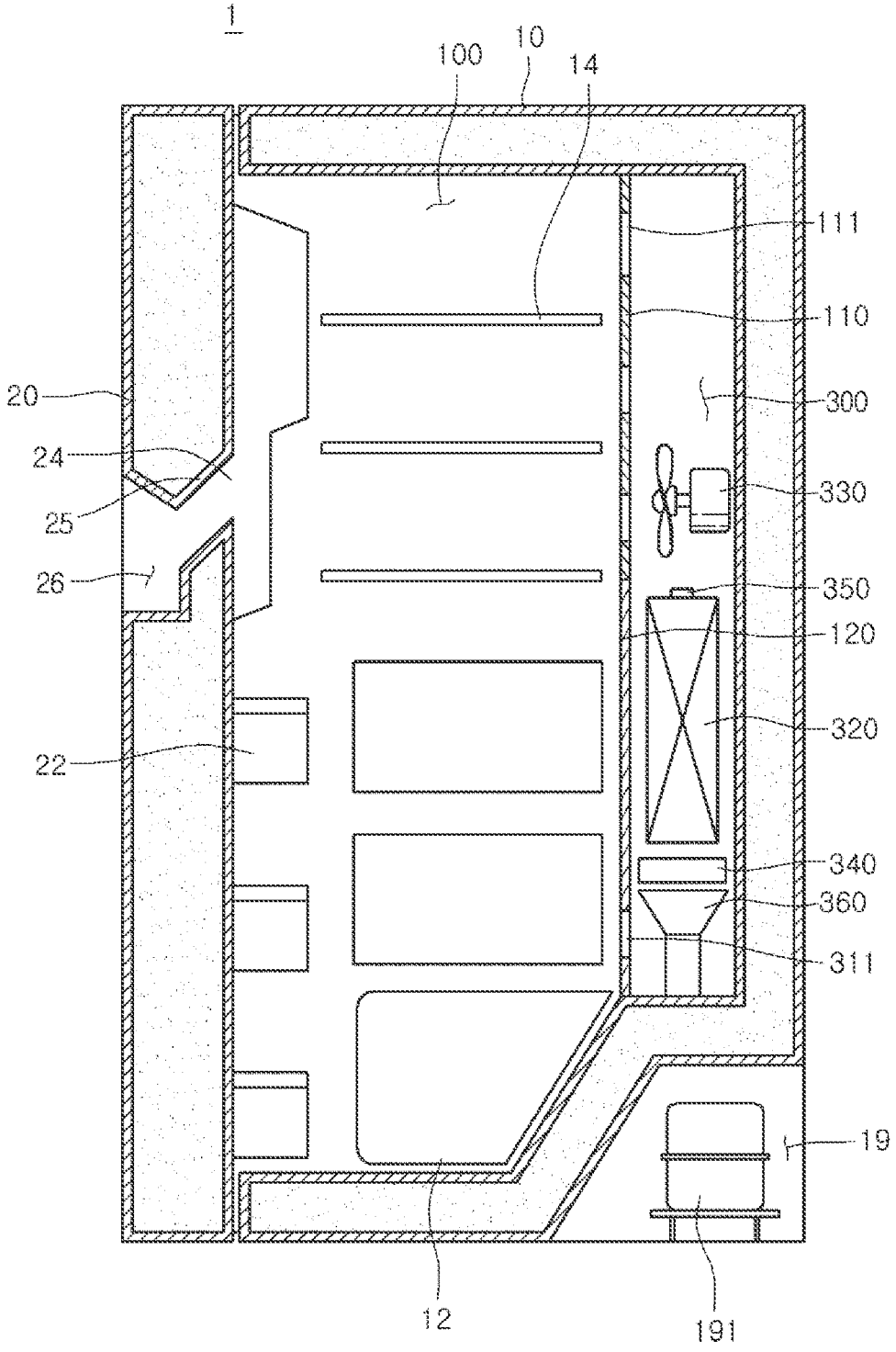
FIG. 1 is a cross-sectional view illustrating a refrigerator according to an embodiment.

FIG. 1 is a cross-sectional view illustrating a refrigerator according to an embodiment.

Referring to FIG. 1, a refrigerator 1 according to the current embodiment includes: a main body 10 including a refrigerator compartment and a freezer compartment 100; a freezer compartment door 20 rotatably disposed on the front part of the main body 10 to selectively open and close the freezer compartment 100; and a refrigerator compartment door rotatably disposed on the front part of the main body 10 to selectively open and close the refrigerator compartment. The freezer compartment 100 and the refrigerator compartment are separated from each other by a barrier (not shown).

The freezer compartment 100 and the refrigerator compartment may be provided with drawers 12 in which food is stored, and shelves 14 on which food is placed. Door baskets 22 for storing food may be installed on the rear surface of the freezer compartment door 20. Depending on the type of the refrigerator 1, an ice making device 24 may be disposed in the freezer compartment 100 or on the rear surface of the freezer compartment door 20. Ice made in the ice making device 24 is discharged through a duct 25 disposed in the freezer compartment door 20, and is dispensed through a dispenser 26 connected to the duct 25. The drawers 12, the shelves 14, and the door baskets 22, as food storages, make it possible for a user to conveniently put in and take out food, and increase usage efficiency of the inner space of the refrigerator 1.

An evaporation compartment 300 is disposed behind the freezer compartment 100, and accommodates an evaporator 320 in which refrigerant exchanges heat with air to generate cold air. The evaporation compartment 300 is closed by an evaporator cover 120. A cold air duct 110 vertically extends at the upper side of the evaporator cover 120 to guide cold air generated in the evaporator 320. A blower fan 330 is disposed at the upper side of the evaporator 320 to blow cold air generated in the evaporator 320, into the freezer compartment 100 through cold air discharge holes 111 disposed in the cold air duct 110.

A defrosting sensor 350 is installed on the evaporator 320 to sense an amount of frost formed on the outer surface of the evaporator 320. A defrosting heater 340 is disposed under the evaporator 320 to melt frost formed on the outer surface of the evaporator 320 or the evaporation compartment 300.

A cold air suction hole 311 is disposed under the cold air duct 110 such that cold air circulating within the freezer compartment 100 is returned to the evaporator 320. A suction fan may be disposed inside of the cold air suction hole 311 to efficiently suction cold air into the evaporation compartment 300.

A machinery compartment 19 is disposed in the lower part of the refrigerator 1. A compressor 191 and a condenser (not shown), which constitute a cooling cycle, are accommodated in the machinery compartment 19.

Figure 2:
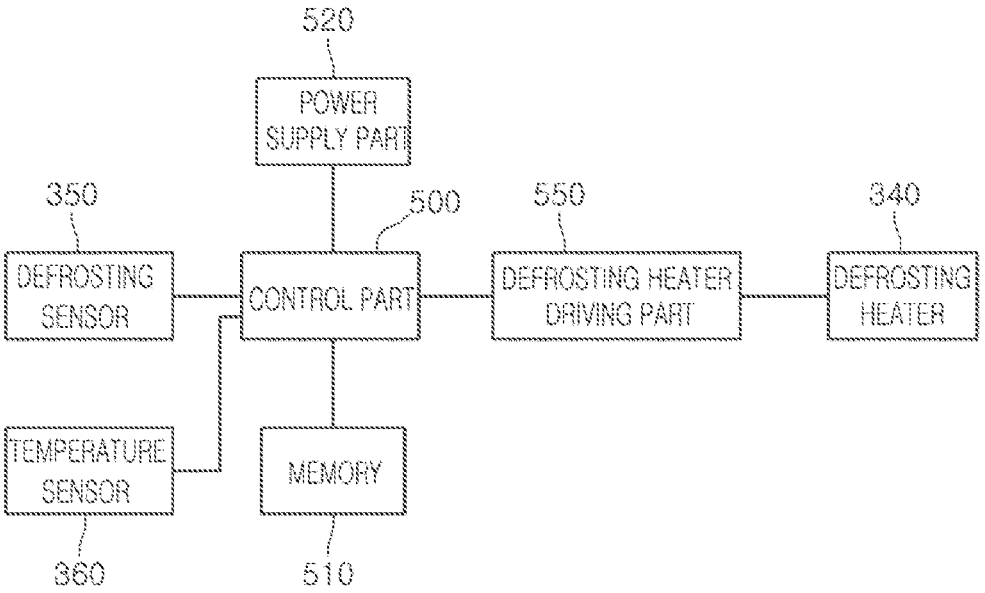
FIG. 2 is a block diagram illustrating a control configuration of the refrigerator of FIG. 1.

FIG. 2 is a block diagram illustrating a control configuration of the refrigerator of FIG. 1.

Referring to FIG. 2, the refrigerator 1 includes a control part 500 for controlling operations of components thereof. The control part 500 controls: a memory 510 for storing information used to operate the refrigerator 1; a power supply part 520 for supplying power to components of the refrigerator 1; the defrosting sensor 350 for sensing an amount of frost formed on the evaporator 320; and a defrosting heater driving part 550 for driving the defrosting heater 340.

The defrosting sensor 350 senses an amount of frost formed on the evaporator 320, and the control part 500 compares the sensed amount of frost with a pre-input reference value to determine whether to drive the defrosting heater 340. That is, a defrosting start time and a defrosting end time of the defrosting heater 340 for removing frost formed on the evaporation compartment 300 or the evaporator 320 are determined. The defrosting sensor 350 may be any device for sensing an amount of frost formed on the evaporator 320. For example, the defrosting sensor 350 may be an infrared sensor.

Particularly, the infrared sensor includes: a light emitting part for emitting an infrared ray; and a light receiving part for sensing the amount of an infrared ray emitted from the emitting part and reflected by frost. Thus, a frost formation amount may be sensed based on an infrared reflection amount sensed by the light receiving part. Frost formation amounts according to amounts of received infrared rays, and sensing periods of the defrosting sensor 350 according to frost formation amounts may be stored in the form of a lookup table in the memory 510. Thus, a frost formation amount is determined by comparing a value, actually sensed by the defrosting sensor 350, with a lookup table. According to the determined frost formation amount, a sensing period of the defrosting sensor 350 is reset.

The defrosting heater driving part 550 is connected to the defrosting heater 340. When the defrosting heater driving part 550 receives a driving signal from the control part 500, the defrosting heater driving part 550 drives the defrosting heater 340 to melt frost formed on the evaporator 320.

In detail, the memory 510 may store sensing frequencies of the defrosting sensor 350, and defrosting start times when the defrosting heater 340 starts a defrosting operation.

The control part 500 may control a sensing operation of the defrosting sensor 350 according to a sensing period stored in the memory 510, and calculate a defrosting start time stored in the memory 510, according to a frost formation amount sensed by the defrosting sensor 350 to thereby issue a driving order to the defrosting heater driving part 550.

Figure 3:
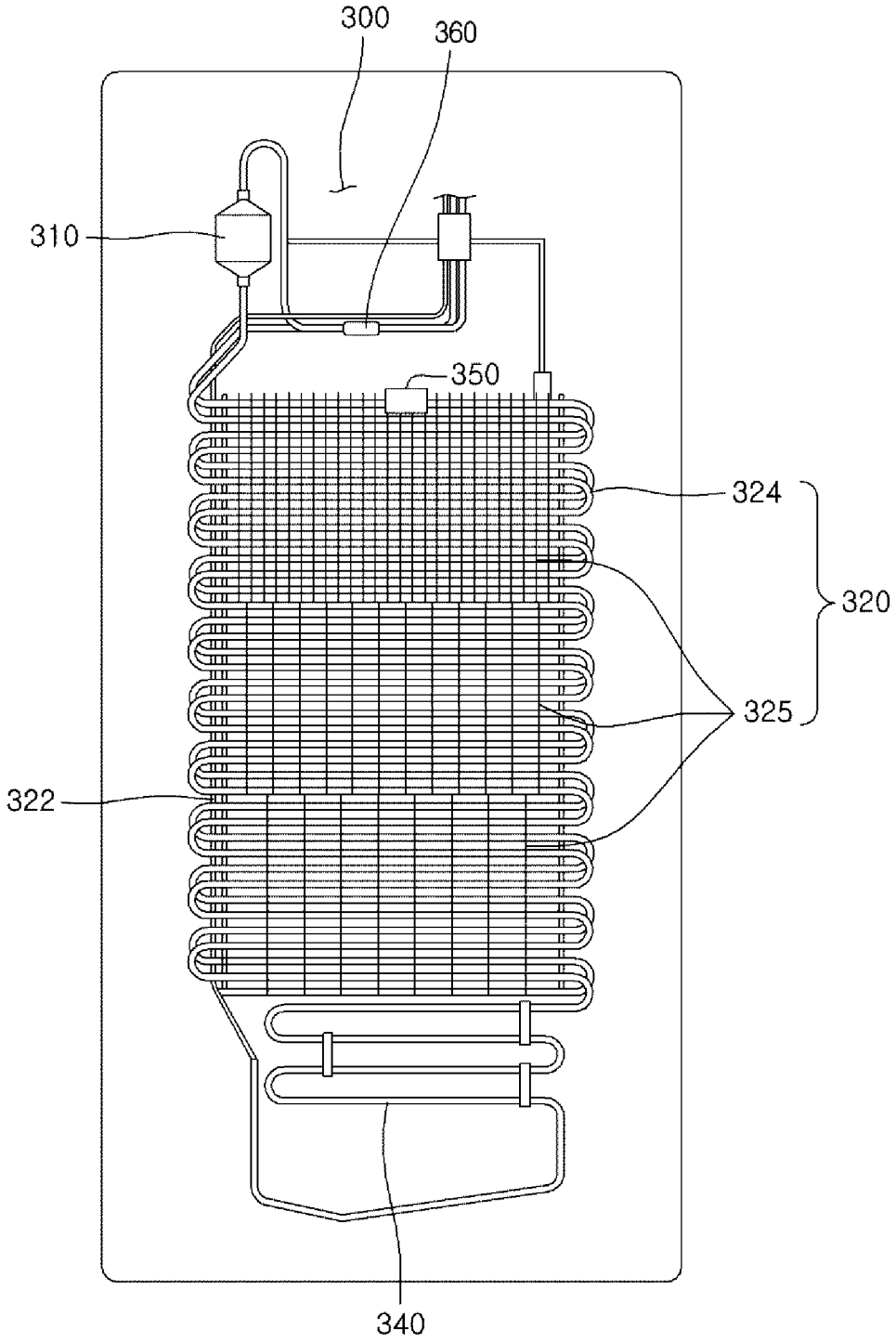
FIG. 3 is a schematic view illustrating a defrosting system of the refrigerator of FIG. 1.

FIG. 3 is a schematic view illustrating a defrosting system of the refrigerator of FIG. 1.

Referring to FIG. 3, the evaporator 320 may be vertically disposed within the evaporation compartment 300, and the defrosting heater 340 may be disposed under the evaporator 320. A dryer 310 may be disposed above the evaporator 320 to remove moisture and impurities from refrigerant. That is, the evaporator 320 is configured to receive refrigerant from the upper side thereof.

The evaporator 320 includes: refrigerant tubes 324 as passages through which refrigerant flows; and heat exchange fins 325 for improving heat exchange between refrigerant and air passing through the evaporation compartment 300. The refrigerant tubes 324 form meander line having bends. Refrigerant flows through the refrigerant tubes 324. As illustrated in FIG. 3, the refrigerant tubes 324 may be arrayed at least in two layers spaced apart from each other in the back and forth direction of the refrigerator 1. A temperature sensor 360 may be installed on the dryer 310 or an inlet of the refrigerant tubes 324 to measure temperature of refrigerant introduced into the evaporator 320.

Brackets 322 may be disposed at the left and right sides of the evaporator 320, that is, at bends of the refrigerant tubes 324. Both ends of the refrigerant tubes 324 are inserted and fixed in the brackets 322 that are vertically elongated to correspond to the vertical length of the evaporator 320. The brackets 322 are installed on an inner surface of the evaporation compartment 300 to fix and install the evaporator 320 within the evaporation compartment 300.

The heat exchange fins 325 are coupled to the evaporator 320. The heat exchange fins 325 increase a surface area of the evaporator 320 to improve heat exchange efficiency between air within the evaporation compartment 300 and refrigerant passing through the evaporator 320, and may be formed of aluminum that has high thermal conductivity.

The defrosting sensor 350 may be installed on the evaporator 320. The defrosting sensor 350 may be installed on the upper side of the evaporator 320. In detail, the defrosting sensor 350 may be attached to the refrigerant tubes 324 or the heat exchange fins 325. A sensing period of the defrosting sensor 350 may be varied to selectively measure an amount of frost formed on the evaporator 320. The defrosting sensor 350 may be any sensor such as an infrared sensor or a temperature sensor to sense an amount of frost formed on the evaporator 320 or the evaporation compartment 300.

Figure 4:
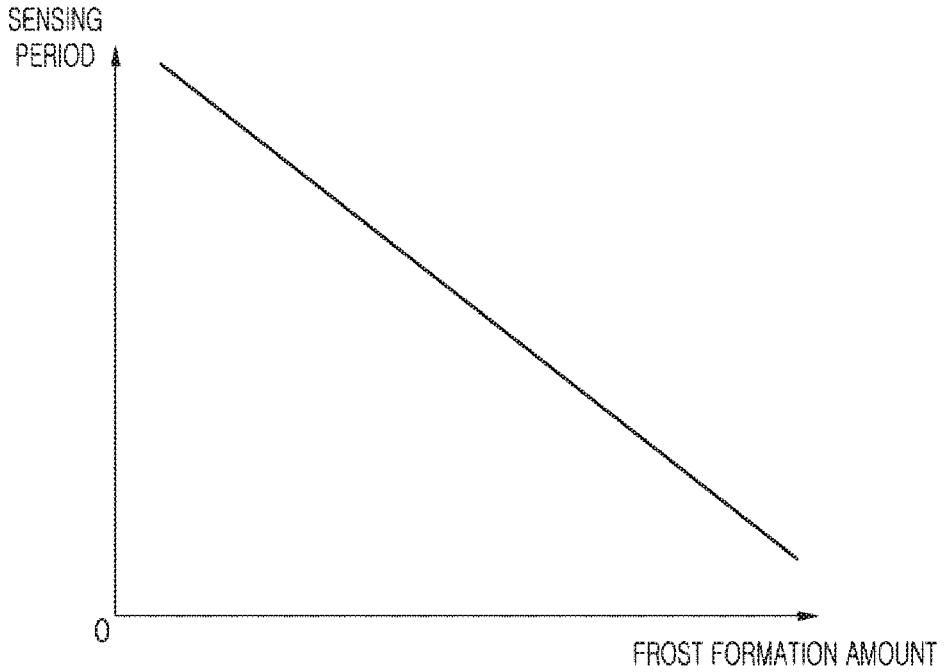
FIG. 4 is a graph illustrating sensing periods of a defrosting sensor according to amounts of frost formed on an evaporator of FIG. 1.

FIG. 4 is a graph illustrating sensing periods of the defrosting sensor according to amounts of frost formed on the evaporator of FIG. 1.

Referring to FIG. 4, as an amount of frost formed on the evaporator 320 increases, a sensing period of the defrosting sensor 350 is decreased. That is, a frost formation amount is inversely proportional to a sensing period. For example, when a small amount of frost is formed on the evaporator 320, a next sensing period of the defrosting sensor 350 is set to be long. When a great amount of frost is formed on the evaporator 320, a next sensing period of the defrosting sensor 350 is set to be short. A variation in a sensing period depending on a frost formation amount may be appropriately set according to a condition of the evaporator 320 on which the defrosting sensor 350 installed, and a condition of the evaporation compartment 300 in which the defrosting sensor 350 is installed. Sensing frequencies according to frost formation amounts may be provided in the form of a table based on data obtained through experiments, and be stored in a memory.

Hereinafter, a defrosting method depending on a frost formation amount sensed by the defrosting sensor 350 will now be described.

Figure 5:
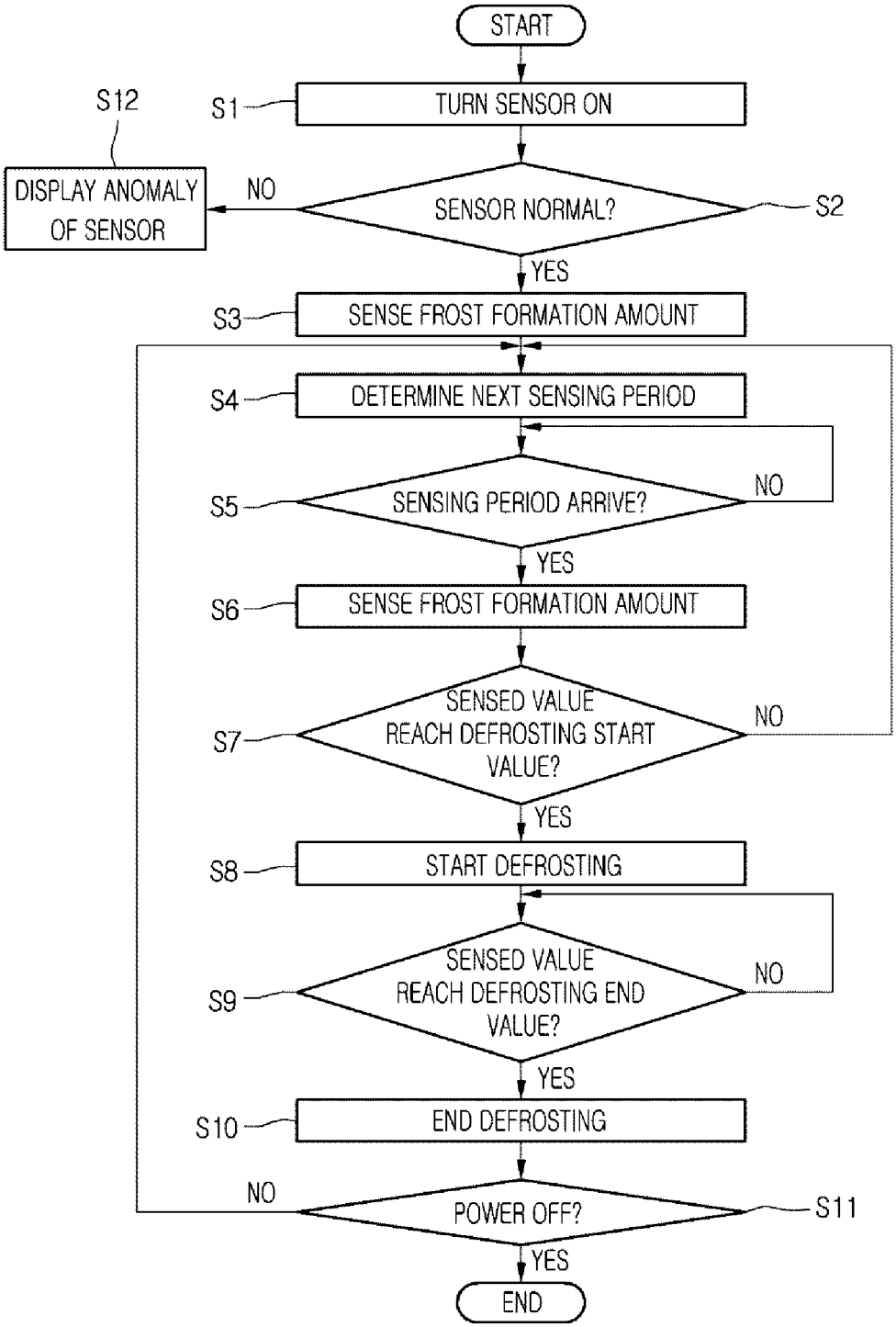
FIG. 5 is a flowchart illustrating a defrosting control method of the refrigerator of FIG. 1.

FIG. 5 is a flowchart illustrating a defrosting control method of the refrigerator of FIG. 1.

Referring to FIG. 5, when the power supply part 520 supplies power to the defrosting sensor 350 in operation S1, it is determined whether the defrosting sensor 350 is normal in operation S2. If the defrosting sensor 350 is abnormal, the control part 500 may display an anomaly of the defrosting sensor 350 on a display part (not shown) of the refrigerator 1 in operation S12. If the defrosting sensor 350 is normal, the defrosting sensor 350 senses an amount of frost formed on the evaporator 320 in operation S3, and a next sensing period of the defrosting sensor 350 is determined according to the sensed amount of frost in operation S4. After the next sensing period of the defrosting sensor 350 is determined, the control part 500 determines whether the next sensing period of the defrosting sensor 350 arrives in operation S5. If the next sensing period of the defrosting sensor 350 does not arrive, the control part 500 continually determines again whether the next sensing period of the defrosting sensor 350 arrives. If the next sensing period of the defrosting sensor 350 arrives, the defrosting sensor 350 senses a frost formation amount in operation S6, and transmits a result of the sensing to the control part 500. In operation S7, the control part 500 determines whether the transmitted result reaches a preset defrosting start value. That is, the control part 500 determines whether the sensed frost formation amount reaches a frost formation amount satisfying a defrosting start criterion. Unless the transmitted result reaches the preset defrosting start value, a next sensing period is determined according to the transmitted result. For example, if a currently sensed frost formation amount does not reach a defrosting start value and is greater than a previously sensed frost formation amount, a next sensing period is set to be shorter than a previous sensing period. On the contrary, if the currently sensed frost formation amount is smaller than the previously sensed frost formation amount, the next sensing period may be set to be longer than the previous sensing period, since it is determined that a cooling cycle removes frost without an additional process.

If the transmitted result reaches the preset defrosting start value, the control part 500 operates the defrosting heater driving part 550 to start a defrosting process in operation S8. According to the operation of the defrosting heater driving part 550, the defrosting heater 340 removes frost formed on the evaporator 320. While the defrosting heater 340 removes frost formed on the evaporator 320, the defrosting sensor 350 senses, with a certain interval of time, an amount of frost remaining on the evaporator 320. Then, in operation S9, it is determined whether the sensed amount of frost remaining on the evaporator 320 reaches a defrosting end value. Also in this case, a control algorithm for varying a sensing period may be used. That is, when a currently sensed frost residue amount is smaller than a previously sensed frost residue amount, a sensing period of the defrosting sensor 350 may be decreased. Accordingly, a defrosting end time can be accurately figured out.

If an amount of frost remaining on the evaporator 320 reaches the defrosting end value, the control part 500 stops the defrosting heater driving part 550 to end the defrosting process in operation S10. After the defrosting process is ended, unless the refrigerator 1 is turned off, a next sensing period is determined again in operation S4. Alternatively, after the defrosting process is ended, it may be determined again whether the defrosting sensor 350 is normal in operation S2.

Figure 6:
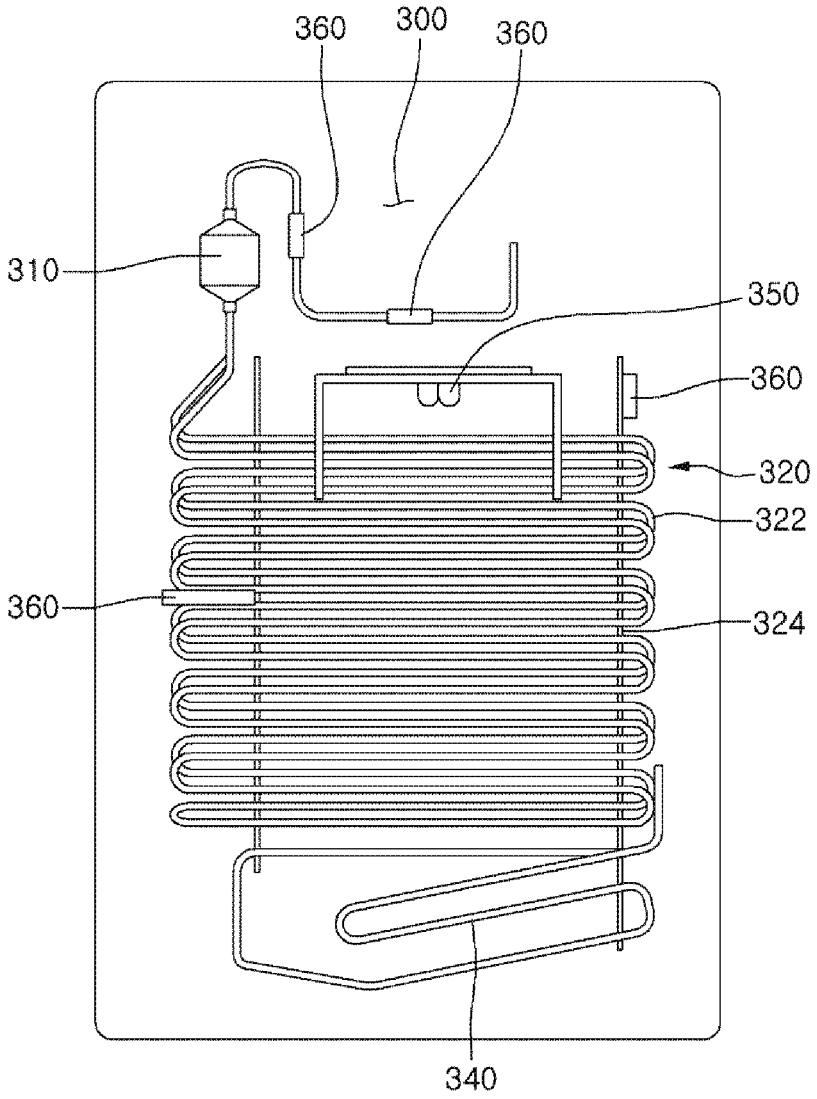
FIG. 6 is a schematic view illustrating a defrosting system of a refrigerator according to another embodiment.

FIG. 6 is a schematic view illustrating a defrosting system of a refrigerator according to another embodiment.

Referring to FIG. 6, a defrosting sensor 350 includes an infrared sensor, and a temperature sensor 360 senses temperature of refrigerant flowing through an evaporator 320, as in the previous embodiment, and the defrosting sensor 350 and the temperature sensor 360 are used to measure a frost formation amount and a defrosting time.

In detail, the defrosting sensor 350 including the infrared sensor is disposed in a certain position on the evaporator 320 where a frost formation amount is largest. The temperature sensor 360 is disposed in another position on the evaporator 320 out of a sensing range of the defrosting sensor 350. For example, the temperature sensor 360 may be disposed above the defrosting sensor 350, and be installed on a tube connected to the evaporator 320 or on an inlet of the evaporator 320. Alternatively, the temperature sensor 360 may be disposed at a left or right edge of the evaporator 320, or at a left or right top thereof. The temperature sensor 360 may be provided in plurality, and the defrosting sensor 350 may be an infrared sensor including a light emitting part and a light receiving part, as in the previous embodiment.

Figure 7:
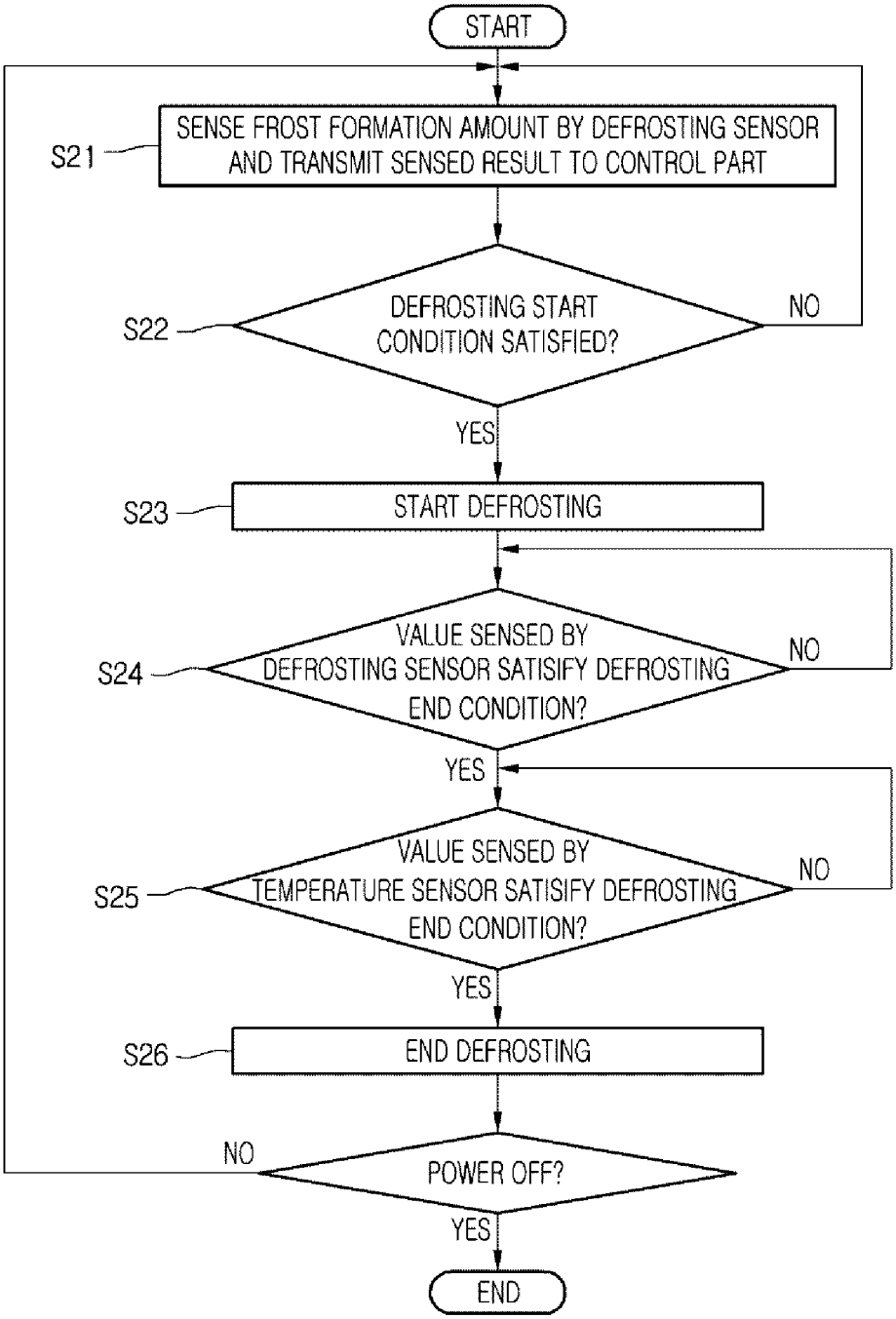
FIG. 7 is a flowchart illustrating a defrosting control method of the refrigerator of FIG. 6.

FIG. 7 is a flowchart illustrating a defrosting control method of the refrigerator of FIG. 6.

Referring to FIG. 7, the defrosting sensor 350 and the temperature sensor 360 are used together to determine a defrosting start time and a defrosting end time.

In detail, in operation S21, the defrosting sensor 350 senses a frost formation amount, and transmits a result of the sensing to a control part. Then, in operation S22, the control part determines whether the result of the sensing satisfies a defrosting start condition. That is, the control part determines whether the sensed frost formation amount reaches a frost formation amount satisfying a defrosting start criterion. If the result of the sensing satisfies the defrosting start condition, a defrosting process is started in operation S23. Unless the result of the sensing satisfies the defrosting start condition, the defrosting sensor 350 periodically senses a frost formation amount. At this point, a sensing period of the defrosting sensor 350 may be varied using a same method as that of the previous embodiment.

After the defrosting process is performed for a set time, the defrosting sensor 350 senses a frost formation amount. The sensed frost formation amount is an amount of frost remaining on the evaporator 320. It is determined whether a result of the sensing satisfies a defrosting end condition in operation S24. If the result of the sensing satisfies the defrosting end condition, it is determined whether a temperature sensed by the temperature sensor 360 satisfies the defrosting end condition in operation S25. If the temperature sensed by the temperature sensor 360 satisfies the defrosting end condition, the defrosting process is ended in operation S26. Then, as in the previous embodiment, unless a refrigerator is turned off, a control algorithm of operations S21 to S26 is repeated.

To determine whether the defrosting start condition and the defrosting end condition are satisfied, a memory stores in advance reference values corresponding to a frost formation amount for starting defrosting, a frost formation amount for ending defrosting, and a refrigerant temperature for ending defrosting. Then, an actually sensed frost formation amount and an actually sensed temperature are compared with the reference values. If the actually sensed frost formation amount reaches the corresponding reference value, the defrosting process is started. If the actually sensed frost formation amount reaches the corresponding reference value, and the actually sensed temperature is equal to or higher than a defrosting end temperature, the defrosting process is ended.

As such, the defrosting sensor 350 and the temperature sensor 360 are used together, thereby sensing the entire surrounding of the evaporator 320. Thus, all frost formed on the evaporator 320 can be reliably removed.

The defrosting control method according to the current embodiment includes the defrosting control method according to the previous embodiment. In addition, a defrosting end time is primarily determined based on a frost formation amount, and is secondarily determined based on a temperature sensed by the temperature sensor 360.

Alternatively, instead of using the method of varying a sensing period of a defrosting sensor in the previous embodiment, a fixed sensing period may be used together with a defrosting control method of determining a defrosting end time through two stages within the scope of the present disclosure.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A refrigerator comprising:

a main body including a food storage space and an evaporation compartment;

a door selectively closing the food storage space;

an evaporator disposed in the evaporation compartment;

a defrosting heater configured to remove frost from a surface of the evaporation compartment or the evaporator;

a defrosting sensor including an infrared sensor comprising:

a light emitting part for emitting an infrared light; and a light receiving part for receiving infrared light emitted from the light emitting part and reflected by the frost, wherein the defrost sensor is configured to sense a frost formation which is determined according to an amount of infrared light received by the light receiving part;

at least one temperature sensor for sensing a temperature of the evaporator; and a control part configured to:

receive a sensed value transmitted from the defrosting sensor;

control an operation of the defrosting heater according to the sensed value; and vary a sensing period of the defrosting sensor according to a frost formation amount sensed by the defrosting sensor, the sensing period configured to be defined as a time interval from a current sensing point to a next sensing point, wherein the sensing period is configured to be inversely proportional to the frost formation amount.

2. The refrigerator according to claim 1, wherein the control part is configured to provide that unless a frost formation amount sensed by the defrosting sensor reaches a set value for starting defrosting, a next sensing period is set based on the sensed frost formation amount.

3. The refrigerator according to claim 2, wherein the control part is configured to provide that when a frost formation amount sensed by the defrosting sensor is greater than a previously sensed frost formation amount, a next sensing period is shorter than a previous sensing period.

4. The refrigerator according to claim 1, wherein the control part is configured to:

operate the defrosting heater to start a defrosting process when a frost formation amount sensed by the defrosting sensor reaches a set value for starting defrosting;

stop the operation of the defrosting heater to end the defrosting process when the frost formation amount reaches a set value for ending defrosting; and control the defrosting sensor to periodically sense an amount of frost residue during the defrosting process.

5. The refrigerator according to claim 4, wherein the control part is configured to vary the sensing period of the defrosting sensor when the amount of the frost residue sensed during the defrosting process is different from a previously sensed amount of frost residue.

6. The refrigerator according to claim 4, wherein the control part is configured to shorten the sensing period of the defrosting sensor when the amount of the frost residue sensed during the defrosting process is smaller than a previously sensed amount of frost residue.

7. The refrigerator according to claim 1, wherein the temperature sensor is configured to sense the temperature of the evaporator during the defrosting process.

8. The refrigerator according to claim 1, wherein the control part is configured to end the defrosting process when a value sensed by the defrosting sensor reaches a defrosting end value, and a temperature sensed by the temperature sensor reaches a defrosting end temperature.

9. The refrigerator according to claim 1, wherein the control part is configured to provide that unless a frost formation amount sensed by the defrosting sensor reaches a set value for starting defrosting, a next sensing period is set based on the currently sensed frost formation amount.

10. The refrigerator according to claim 9, wherein the control part is configured to provide that when a frost formation amount sensed by the defrosting sensor is greater than a previously sensed frost formation amount, a next sensing period is shorter than a previous sensing period.

11. The refrigerator according to claim 1, wherein the control part is configured to vary the sensing period of the defrosting sensor when the amount of the frost residue sensed during the defrosting process is different from a previously sensed amount of frost residue.

12. The refrigerator according to claim 11, wherein the control part is configured to shorten the sensing period of the defrosting sensor when the amount of the frost residue sensed during the defrosting process is smaller than a previously sensed amount of frost residue such that a number of the sensing of the frost residue becomes frequent.

* * * * *